United States Patent [19]

Tarulli

[11] 3,994,445

[45] Nov. 30, 1976

[54] COMPENSATOR FOR CONTROLLING THE TENSION OF A WIRE TRAVELLING THROUGH A WIRE-WORKING MACHINE

[75] Inventor: Luigi Tarulli, Teramo, Italy

[73] Assignee: Technofil S. p. A., Ascoli Piceno, Italy

[22] Filed: Nov. 8, 1974

[21] Appl. No.: 522,254

Related U.S. Application Data

[63] Continuation-in-part of Ser. No. 322,479, Jan. 10, 1973, abandoned.

[30] Foreign Application Priority Data

Jan. 10, 1972 Italy ..... 1501/72

[52] U.S. Cl. ..... 242/45; 226/44; 242/25 R

[51] Int. Cl.[2] ..... B65H 59/38

[58] Field of Search ..... 242/45, 25 R, 75.5, 242/75.51; 226/24, 40, 42, 44, 45

[56] References Cited

UNITED STATES PATENTS

| | | | |
|---|---|---|---|
| 1,966,214 | 7/1934 | Palmer | 242/45 |
| 2,203,946 | 6/1940 | Doescher | 242/45 |
| 2,741,437 | 4/1956 | Haworth | 242/45 |
| 3,028,110 | 4/1962 | Kabelitz | 242/45 |
| 3,049,308 | 8/1962 | Lang | 242/45 |
| 3,059,869 | 10/1962 | Ash | 242/45 |
| 3,537,660 | 11/1970 | Schippers et al. | 242/45 |

*Primary Examiner*—Stanley N. Gilreath
*Attorney, Agent, or Firm*—Robert E. Burns; Emmanuel J. Lobato; Bruce L. Adams

[57] ABSTRACT

Apparatus for maintaining constant tension in wire travelling between two driven rolls, one of which delivers the wire; the other being a take-up roll. The apparatus comprises a detector system actuated by the wire while the wire travels in a straight path between the rolls. The detector system comprises a deflector pulley which deflects a portion of the travelling wire from the straight path and a return pulley which returns it thereto. The return pulley is movable toward or away from the deflector pulley in response to tension variations in the wire. A detector detects the variations in distance between the detector pulleys and produces a corrective signal. This signal is used to vary the speed of one of the two driven rolls, in a direction and to an extent responsive to the variation of said distance, thereby keeping the tension of the wire constant between the driven rolls.

4 Claims, 4 Drawing Figures

FIG. 1
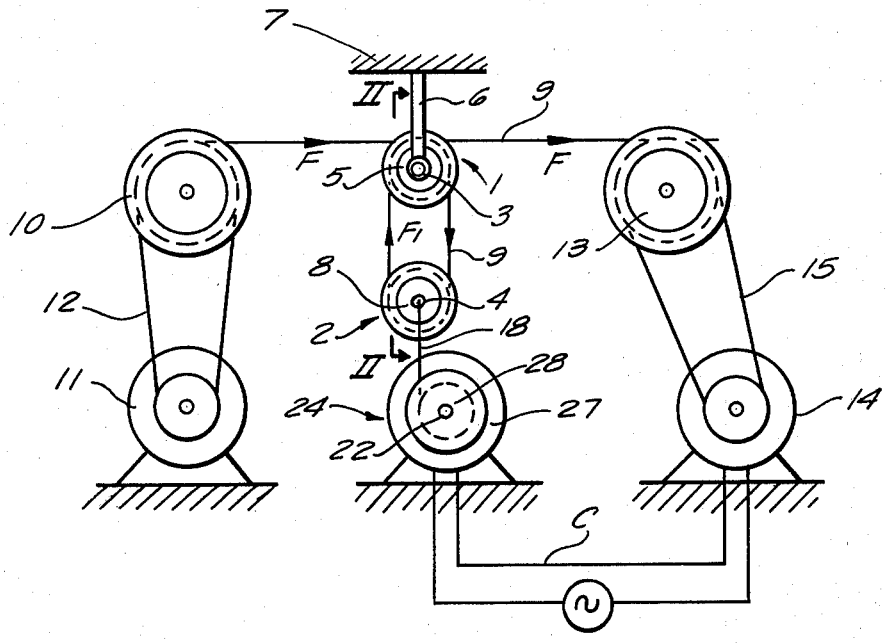
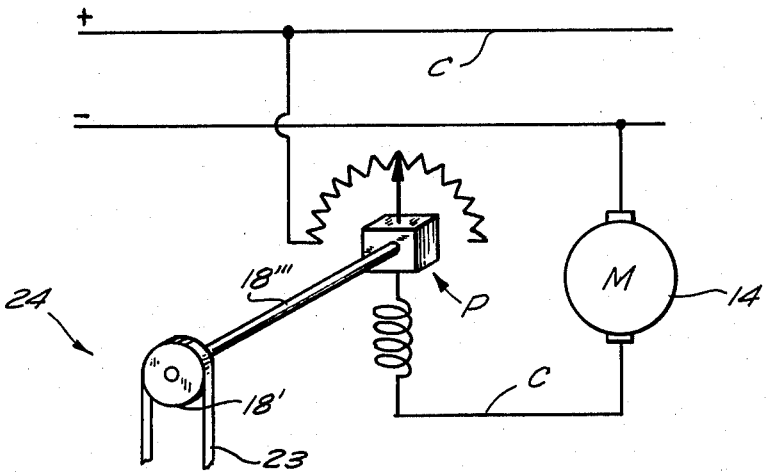
FIG. 3
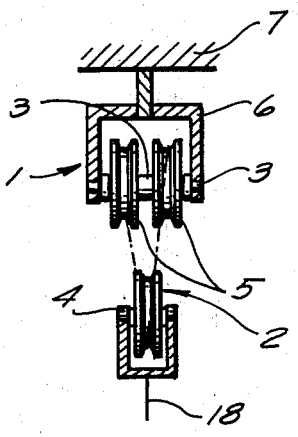
FIG. 2

COMPENSATOR FOR CONTROLLING THE TENSION OF A WIRE TRAVELLING THROUGH A WIRE-WORKING MACHINE

BACKGROUND OF THE INVENTION

This is a Continuation-in-Part of my earlier application Ser. No. 322,479 filed Jan. 10, 1973, now abandoned.

The present invention relates generally to wire-working machines. It deals particularly with apparatus for regulating the tension of wire travelling through a wire-working machine, for example a wire-drawing maachine.

In such a machine a wire is unwound from a feed pulley or roll, driven by a motor, to be rewound on a take-up pulley or roll driven by its own motor. These rolls often run at speeds that differ one from the other. Thereby different tensions are created in the wire. This is particularly the case for the last drawing pulley of the annealing portion of a wire-drawing machine and the first drawing pulley of the winding-up unit of the same machine.

Devices have been designed to compensate such tension differences. Such devices have used transducer-compensators to measure the tension variation and transmit the measurement as a control signal to a speed regulating device of one of the two drawing rolls. A well-known type of such a device comprises a system of wire transmission pulleys including pulley means on a mobile shaft pivoted to a hinge. A spring or a counterweight keeps pulley shafts spaced one from the other. A system of levers, hinged to the mobile shaft, connects that shaft to the regulating device.

Another known type of transducer-compensator places movable transmission pulleys at the ends of a cylinder-piston device.

It has been a difficulty of the known devices that they forced the wire to follow a path which by itself affected the wire tension.

Other known types of transducer-compensator units result from combinations of the above-described ones.

These devices have a number of problems. Important difficulties result from inertia of the transducer-compensator, passive resistances therein, and the variations of the path of the travelling wire caused by the devices themselves. Therefore the above-mentioned earlier devices are generally sufficient only for low speeds. They have a number of drawbacks at high speeds. The drawbacks include:

high inertia, leading to long delays in response;

high passive resistances; and resonating of the device when the tension of the wire undergoes short-lasting periodic changes, for example due to eccentricity of supply or take-up rolls.

SUMMARY OF THE INVENTION

The present invention has as a principal object the provision of a transducer-compensator unit for a wire-working machine, devoid of the above-mentioned drawbacks.

It is another object of the present invention to provide a device which compensates variations in the tensioning of a wire travelling between delivering and take-up pulleys, regardless of whether the variations be generated by different speeds of the pulleys or by other causes.

Another object of the present invention is to provide such a device which can operate promptly, also at high speeds of wire take-up.

The objects are achieved by the device according to the invention which comprises a pulley block inserted in a straight path of travelling wire between wire delivery means and wire take-up means, for deflecting the wire from this straight path and for receiving the deflected wire back for further travel along the straight path. The deflected wire runs around a compensating pulley which is free for movement, transversely of the straight path in response to changes of tension of the wire in the straight path. The compensating pulley thereby produces signals for suitable control of motor means for the wire delivery means and for the wire take-up means.

BRIEF DESCRIPTION OF THE DRAWINGS

FIG. 1 is a side elevation of a first embodiment of the invention;

FIG. 2 is a fragmentary section taken along lines II-II in FIG. 1;

FIG. 3 is a perspective view of a slightly modified detail; and

DESCRIPTION OF THE PREFERRED EMBODIMENTS

Figure 4:
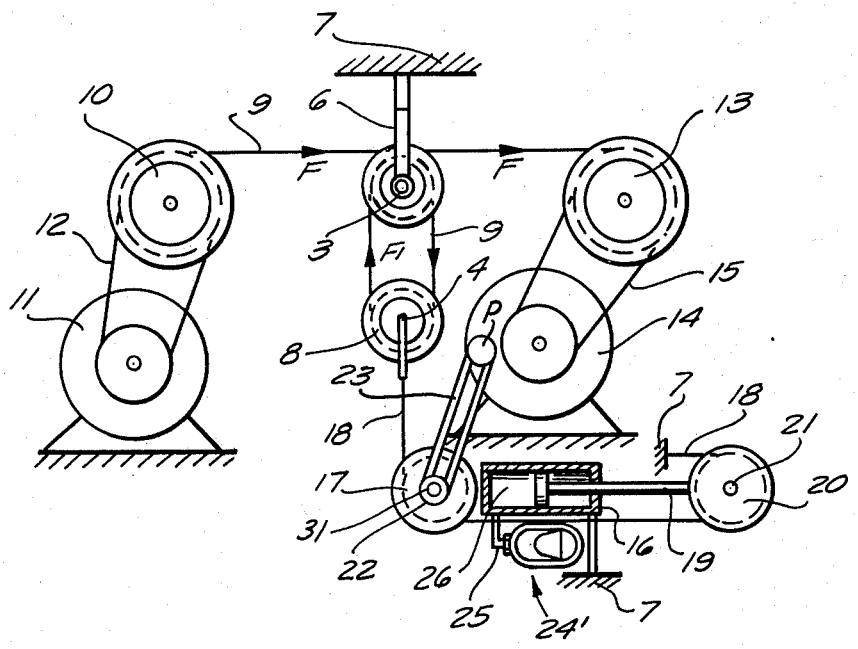
FIG. 4 is a side elevation of a second embodiment of the invention.

As shown in FIGS. 1 to 3 a compensator pulley block 1 is loated between a wire delivery pulley and roll 10 and a wire take-up pulley and roll 13, so that the wire 9 can run along a substantially straight path from delivery roll 10 over pulley block 1 and further to take-up roll 13. Two pulleys 5 of pulley block 1 are rotatably mounted on a first fixed shaft 3 in this block, this shaft extending from one to the other of two arms of a fixed holder 6, as best shown in FIG. 2. A compensator pulley unit 2 is freely suspended from and below block 1 on wire 9. The unit 2 comprises a pulley 8 rotatable on a second shaft 4 generally parallel to shaft 3 as shown. The delivery roll 10 is driven by a motor 11, through a belt 12. The take-up roll 13 is driven by its own motor 14 through a belt 15.

The pulley unit 2 is capable of vertical movements F1, transverse of the horizontal path F of the travelling wire 9, in response to varying tensions in this wire along this path.

In addition the movable pulley unit can tilt, in the plane of FIG. 2, in response to small, differential tensions in the wire sections between this unit and block 1, and can thereby produce oscillations of shaft 4, particularly in the plane of shafts 3 and 4. Harmful effects of the aforementioned types, which could otherwise lead even to bending of the wire, are avoided in ths way.

Since the path F remains straight-lined, regardless of these movements, the vertical excursions F-1 of unit 2 provide a direct and accurate response, generally proportional to the changes of tensions. The response is sensitive as the mass of the movable pulley 8 is minimal.

As shown in the drawing, this response is impressed on drive motor 14 of take-up roll 13. This is done with the aid of a wire 18 which links drawing pulley unit 2 with a detector unit 24, and with the further aid of circuit means between detector unit 24 and motor 14. FIGS. 1 and 3 schematically show one type of detector unit, wherein a belt 23 connects a pulley 28, rotatable by linking wire 18 upon the vertical excursions of movable pulley 8, with a pulley 18' which adjusts a potentiometer unit P by shaft 18'''. The potentiometer unit in turn controls the take-up motor 14.

In a more elaborate embodiment, the detector unit 24 (FIG. 1) may comprise a torque motor 27, that is, an electric motor having keyed to its shaft 22 a pulley 28 whereon the wire 18 is wound. This pulley 28 can be connected, by means similar to belt 23 and pulley 18' (FIG. 3), to electric control means P for motor 14 of roll 13. As is generally known, the rotor of torque motor 27, being stalled or allowed only to rotate slowly by the upward tension of wire 9 transmitted by linking wire 18, steadily maintains a torque reaction on this pulley 28, downwardly acting on linking wire 18. Thus the torque motor 27 acts as an accumulator of electrical energy, derived from changing tensions in wire 9, through vertical movements of pulley unit 2.

Another compensating device is shown FIG. 4. Here a cylinder 16 is fixed to the frame 7 of the wire-drawing machine. The cylinder carries at one end a pulley 17 for linking wire 18. One end of this wire is connected to the axis 4 carrying the compensating pulley 8. The other end of wire 18 is connected to the frame 7 of the drawing machine. The piston rod 19 of the cylinder-piston carries at a free end, externally of the cylinder, an idler pulley 20 on an axis 21 fixed to the piston rod 19. A gear wheel 22 is keyed to the shaft 31 of the pulley 17 and is connected by a toothed belt 23 to a regulation device P.

An element is provided which tends to increase the distance between the shafts 3 and 4. It comprises a hydropneumatic energy accumulator indicated schematically at 24'. The accumulator 24' is connected by a duct 25 to a chamber 26 in cylinder 16. It tends to move the piston of rod 19 and thereby the pulley 20 (towards the right as shown), to pull linking wire 18 and thereby compensating pulley 8 down, and thus to increase the distance of shaft 4 of this pulley from the fixed shaft 3. The accumulator is, for example, of the type formed by a container containing oil and an inert gas such as nitrogen, separated the one from the other by an elastic diaphragm, with the oil in that part of the container closest to the chamber 26.

The device of FIG. 4 operates as follows: Upon a demand for more wire by the wire take-up roll 13, the compensating pulley 8 is displaced in the direction of the pulley 5 causing corresponding detector pulley 18' to rotate. The piston rod 19 moves relative to the cylinder 16 reducing the volume of the chamber 26. The oil contained in this chamber is partially transmitted to the accumulator 24' so that the gas contained in the accumulator is temporarily compressed. The rotation of the detector pulley 18' causes the adjusting action of a potentiometer (FIG. 3) inserted into the supply circuit of the drive motor 14 for the take-up roll 13. The speed of this roll is thereby reduced. The operation of the machine returns to normal when the accumulator returns the energy stored by the gas, compressing the oil in the direction of the chamber 26 through the duct 25.

It is evident that many further modifications and variants may be applied to the invention, within the scope of the following claims.

What I claim and desire to secure by Letters Patent is:

1. A wire working machine, comprising; wire drawing pulleys, disposed for passing a wire from one to the other; motors for respectively driving the pulleys; and a tension compensator for substantially maintaining a predetermined tension in the wire passing from one of the pulleys to the other, comprising;

a first shaft having a first compensator pulley thereon, said first shaft and compensator pulley being located between the wire drawing pulleys;

a second and movable compensator pulley having a shaft and being suspended from the first compensator pulley by the wire the predetermined tension of which is to be substantially maintained and which extends from one of the wire drawing pulleys to and around the first and second compensator pulleys in succession and therefrom to the other wire drawing pulley, so that the tension in the wire acts to move the movable compensator pulley towards the first compensator pulley when the tension increases, while disposing the movable compensator pulley and its shaft to tilt in response to differential tensions in the wire;

an energy accumulator for producing a reaction force to said tension to move the movable compensator pulley and its shaft away from the first compensator pulley when the tension decreases;

a detector for producing signals in response to variations in the distance from the first to the second compensator pulley; means for transmitting the signals produced by the detector to one of the motors to regulate the driving of the respective wire-drawing pulley; and a linking wire, linking the energy accumulator to the movable pulley and its shaft via the detector to operate the detector in response to said tension and said reaction force, while leaving the movable pulley and its shaft elastically free for said tilting and response to differential tensions in the wire.

2. A machine according to claim 1, in which the detector has a detector shaft for operating it; and means for turning the detector shaft in response to the moving of the movable pulley and shaft by the linking wire.

3. A machine according to claim 1, in which the detector includes a potentiometer, and the means for transmitting the signals comprises an electric circuit connecting the potentiometer with said one motor for driving the respective wire-drawing pulley.

4. A machine according to claim 1, in which the energy accumulator comprises a fluid pressure accumulator having first and second parts movable relative to one another and having first and second accumulator pulleys, rotatably mounted on said parts respectively;

the linking wire having a first end portion secured to the movable compensator pulley and its shaft, a fixed second end portion, and an intermediate portion passing around the accumulator pulleys in succession, the linking wire being kept in tension by the accumulator and the pulley-suspending wire.

* * * * *